United States Patent [19]

Kankaanpaa

[11] 4,326,456

[45] Apr. 27, 1982

[54] METHOD AND APPARATUS FOR CALENDERING PAPER WEBS OR THE LIKE

[75] Inventor: Matti Kankaanpaa, Espoo, Finland

[73] Assignee: Valmet Oy, Finland

[21] Appl. No.: 192,026

[22] Filed: Sep. 29, 1980

[30] Foreign Application Priority Data

Oct. 15, 1979 [FI] Finland ..... 793201

[51] Int. Cl.[3] ..... B30B 3/04

[52] U.S. Cl. ..... 100/41; 100/162 R

[58] Field of Search ..... 100/160, 161, 162 R, 100/35, 41

[56] References Cited

U.S. PATENT DOCUMENTS 3,905,288 9/1975 Holm ..... 100/162 R 4,128,053 12/1978 Kankaanpaa ..... 100/162 R

*Primary Examiner*—Billy J. Wilhite

*Attorney, Agent, or Firm*—Steinberg & Raskin

[57] ABSTRACT

Method and apparatus for calendering paper webs or the like wherein a plurality of hard calendering rolls are situated to constitute a roll stack and wherein a plurality of soft calender rolls are situated in nip defining relationship with respective ones of the hard rolls whereby a plurality of corresponding hard and soft or supercalender nips are defined. The apparatus is adapted to be directly associated with a paper machine and force apparatus are provided in conjunction with the apparatus for supporting the hard and soft calender rolls so that the hard nips are closed and the soft nips are open during threading of the web through the apparatus during the start-up phase while the hard nips are opened and the supercalendering nips are closed after the web is threaded in order to perform continuous supercalendering of the paper web.

17 Claims, 4 Drawing Figures

METHOD AND APPARATUS FOR CALENDERING PAPER WEBS OR THE LIKE

BACKGROUND OF THE INVENTION

This invention relates generally to paper machines.

More particularly, the present invention relates to a method for calendering paper webs which employs a plurality of hard or metal rolls and a plurality of soft or filled rolls which are situated to define soft supercalender nips with the hard rolls.

Further, the present invention relates to apparatus for calendering paper webs adapted to be directly associated with a paper machine or the like and to operate as a so-called machine supercalender and which comprises an upright series of hard calender rolls constituting a roll stack and a plurality of soft rolls situated with respect to said hard rolls to define soft supercalender nips with the hard rolls.

The paper web leaving the drying section of a paper machine is generally not suitable for sale as such in that additional finishing operations are still required. One of such finishing operations comprises calendering of the paper web by which the smoothness and gloss or finish of the paper is obtained as is its final desired density. Calendering is accomplished by conducting the continuous paper web through press nips defined between calender rolls as is well known.

Conventionally, calendering is effected through the use of a so-called "machine calender" which is directly associated with the paper machine. It is also well known that the calendering treatment may be supplemented when desired by supercalendering the web in a separate so-called "supercalender".

Such calendering machines in general are constituted by rolls which may be hard rolls or soft rolls. In this connection, as used in the present context, hard rolls will be understood as referring to rolls having a hard, smooth surface formed of a material such as chill-cast iron, steel or the like. In the present context soft rolls will be understood as referring to rolls whose surface layer comprises a resilient, elastic, non-metallic material. In this connection, soft rolls generally comprise so-called filled rolls wherein the resilient material forming the same comprises paper sheets which have been assembled on the core or shaft of the roll at right angles thereto and which have been compressed under large forces to form a coherent, compact roll covering.

The rolls constituting a typical machine calender generally are all hard rolls. On the other hand, soft rolls are used in addition to hard rolls in the calender stacks of supercalenders. Thus, in conventional, well-known supercalenders, hare and soft rolls alternate with each other in the calender stack so that the number of soft rolls is generally substantially the same as the number of hard rolls.

Further as used herein, the term "soft nip" shall be understood as referring in a calender to the line of contact between a soft roll and a hard roll located in nip defining relationship with each other. A "hard nip" will be understood as referring to the line of contact defined between two hard rolls which are in nip defining relationship in the calender stack.

The term "nip" will be understood as being used in its broad sense, i.e., referring not only to the line of contact between two rolls but, additionally, as referring to that region of a roll or rolls where a nip can be established. The operation of separating two rolls which are in mutual nip defining relationship will be referred to as "opening" a nip while the term "closing" a nip will be understood as referring to the step of moving two rolls which are initially separated from each other into nip defining relationship with each other.

Furthermore, as used in the present context the terms "machine calendering" and "machine burnishing" refer to the treatment of a web which is effected exclusively as the same passes through a hard calender nip as a result of which the web is compacted and its surface smoothed so as to obtain a so-called "machine finish". Likewise, the terms "supercalendering" or "super burnishing" will be understood as meaning the web treatment which is effected in soft calender nips and as a result of which a gloss is imparted to the web surface which is substantially superior to the machine finish obtained in hard calender nips. In this connection, it is understood that hard nips may also be found in supercalenders. However, in the context of the present invention, the term "super gloss", rather than indicating the degree of glossiness imparted to a paper web, refers to the fact that the gloss of the web surface has been produced at least a part by a supercalendering process in soft nips. The degree of super gloss accordingly may vary depending, for example, on the number of soft nips utilized in the supercalendering process, on the nip pressure, etc.

Depending on the type of paper which is being treated and on the requirements for the finished product, machine calendering may be accomplished utilizing only a single nip calender, i.e., a calender defined by a single pair of rolls. However, conventionally, a machine calender stack will comprise from six to eight rolls which correspondingly define between five and seven nips.

Generally, the object of the supercalendering process is to obtain an equal gloss on both surfaces of the paper. For this reason, the paper web is generally arranged to pass through the soft nips in a manner such that both surfaces of the web will alternately face a hard roll whose hard, smooth surface will act to produce a gloss to a greater extent than the surface of a soft roll.

In any event, two soft nips will not provide a super gloss to the paper web which would be substantially superior to a machine finish. For this reason, the number of soft nip pairs in supercalendering is usually greater than one and in practice separate supercalender stacks may be utilized having up to ten nip pairs.

In an effort to increase production in paper machines, attempts have been made to design calenders which combine the functions of both machine calenders and supercalenders. For example, applicant's U.S. Pat. No. 4,128,053 discloses a unitary machine-supercalender which is adapted to be directly associated with a paper machine and which is constituted by a conventional roll stack defined by a series of hard rolls and wherein a substantially equal number of soft rolls situated outside of the roll stack in nip defining relationship with the hard rolls define soft nips therewith.

With the above-mentioned combined machine calender and supercalender, it is possible to effect a supercalendering of the web in a desired manner immediately upon the web leaving the paper machine without the need for any intermediate operations. However, it has been found that in certain situations the super gloss imparted to the paper web by the calendering treatment effected by such apparatus is not entirely satisfactory in that the gloss is spotty or mottled rather than being uniform, i.e., localized areas of the surface of the paper web have a higher gloss than other areas. Furthermore, it has been found that a web being subjected to treatment in such a machine-supercalender has a tendency to blacken at localized regions due in part to the drawback that the hard nips found in such apparatus are unduly hard and inelastic with respect to the paper being produced.

SUMMARY OF THE INVENTION

Accordingly, one object of the present invention is to provide new and improved methods for calendering a paper web or the like and apparatus for performing such methods whereby the deficiencies found in the paper manufactured by the above-described calendering techniques are eliminated.

Another object of the present invention is to provide such new and improved methods and apparatus for calendering paper webs wherein "bagging" of the web which frequently occurs due to the distention of the web between certain nips of the calendering apparatus can be eliminated.

Still another object of the present invention is to provide such methods and apparatus for calendering paper webs in which the web can be threaded through the calender apparatus during the start-up phase thereof with ease and in a trouble-free manner at high speeds as in the case of conventional machine calenders.

In accordance with the present invention, these and other objects are attained by providing a method and apparatus wherein the hard rolls and soft rolls constituting the apparatus can be mutually situated during the start-up phase of the machine operation so that when the web is being threaded therethrough, the hard nips defined between the hard rolls are closed and the soft, supercalender nips are opened and wherein during the continuous operation phase of the supercalendering operation, the hard nips are opened and the soft, supercalender nips are closed.

The apparatus of the present invention for performing the above-described method includes support apparatus on which both the hard rolls and soft rolls are mounted and force apparatus operatively associated with the support apparatus operable such that when the web is being threaded through the calendering apparatus during the start-up phase thereof, the hard nips defined between the hard rolls can be closed, and the supercalender nips opened and wherein during the continuous operation phase of the apparatus, the hard nips are opened and the soft, supercalender nips are closed.

According to the invention, the supercalendering operation is accomplished in conjunction with the operation of the paper machine by conducting the web through four consecutive soft nips, the first two of which have soft rolls whose resilient surfaces face the same side of the web while the nips subsequent to the soft nips have soft rolls whose resilient surfaces face the opposite surface of the paper without any substantial treatment of the web in the hard nips during its travel through the soft nips.

In the method and apparatus of the present invention, two distinct phases of operation are considered:

(a) the start-up phase; and (b) the continuous operation phase.

The operation of the calender apparatus during the continuous operation phase may be further considered wherein the apparatus functions (1) as a supercalender, and (2) as a machine calender.

Considering the start-up phase of the operation of the machine, the web will often arrive at the calender apparatus in an intermittent, uneven and/or folded fashion or possibly even having thick lumps formed therein. The soft nips of the calender apparatus must accordingly be open in order to prevent the soft rolls from becoming damaged. Thus, for threading the web through the calender apparatus, only the hard nips are utilized and the start-up phase of operation will continue until a uniformly continuous and trouble-free run of the web through the nips has been stabilized.

In the continuous operation phase, the calender apparatus of the present invention is intended to operate as a supercalender. However, this apparatus can be operated as a conventional machine calender in which case the paper web will travel through only the hard nips. The hard nips in this case, which in the preferred embodiment comprises three hard nips, are generally sufficient in the case of most types of paper to impart an adequate finishing to the web.

Where the calender apparatus of the invention is operated as a supercalender, two structural and functional embodiments are disclosed, namely:

(a) wherein supercalendering of the paper web is accomplished only in the soft nips; and (b) wherein in order to enhance the supercalendering operation, the web is treated in a single hard nip prior to being conducted into the soft nips defined by the soft or filled rolls.

In the latter case, i.e., where a hard nip precedes the soft nip, the web is somewhat softened while large uneven or irregular portions can be smoothed before the supercalendering treatment itself commences. These two pre-treatment steps result in a more efficient supercalendering of the web than if a "raw" paper web were being treated.

It is therefore understood that according to the present invention, the web is subjected to a treatment similar to the treatment effected in supercalenders in general, i.e., only in soft nips, with the conduction of the web through the hard nips defined by hard rolls being limited only to the threading operation during the start-up phase of the apparatus when the paper machine is accelerating to its normal speed after a prior shut-down during normal operation or due to operational malfunctions. However, as noted above, it may be desirable to conduct the web through a single hard nip prior to the soft nips.

According to the present invention, the calender apparatus of the present invention, which may be termed an on-machine supercalender, includes an upstanding series of hard rolls, constituting a vertical roll stack similar to that of a conventional machine calender and, soft rolls situated in a manner such that a pair of soft rolls are situated in nip-defining relationship with a respective one of the hard rolls. In this respect, reference is made to applicant's U.S. Pat. No. 4,128,053.

Preferably, a calender apparatus comprises four hard rolls, at least three of which have their axes situated in a common vertical plane and four soft rolls. The vertical stack of hard rolls includes top and bottom end rolls and a pair of intermediate rolls between the end rolls. The soft rolls are situated in two pairs, each pair of which are themselves situated in nip-defining relationship with a respective one of the intermediate hard rolls.

The machine supercalender of the invention operates in a manner such that during the start-up phase, i.e., during the initiation of the operation of the paper machine, the hard rolls are in nip-defining relationship with each other similar to the arrangement of a conventional machine calender. The soft rolls which are carried by suitable support apparatus outside of the upstanding roll stack, are maintained out of nip contact with the hard rolls. The paper web is threaded in a manner known to those skilled in the art as in conventional machine calenders and with the first and last soft rolls in the direction in which the web is conducted preferably serving as web guiding rolls.

After the web is threaded through the apparatus and is being conducted therethrough in a trouble-free stable manner, the soft rolls are moved into nip-defining relationship with the hard intermediate rolls. Simultaneous with the formation of the soft nips, the hard rolls are separated so as to be spaced from each other and so as to open the hard nips so that the web will only pass through four consecutive soft nips during the continuous operation phase of the apparatus and so that burnishing of the web will be accomplished.

In a particularly advantageous embodiment of the invention, the intermediate hard rolls in the upstanding roll stack are each provided with an independent drive so that their rotational speed can be regulated independently of each other. In this manner, the tension of the web as the same is conducted between the second and third soft nips can be adjusted in order to eliminate any "bagging" of the web. Further, the soft rolls which are operating in nip-defining relationship with the intermediate rolls are themselves preferably each provided with its own drive or, alternatively, may be driven through a belt transmission or the like from the intermediate rolls.

According to another feature of the present invention, the rolls of each pair of soft rolls is situated against a respective intermediate roll symmetrically with respect to the axis of rotation of the particular respective intermediate roll.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
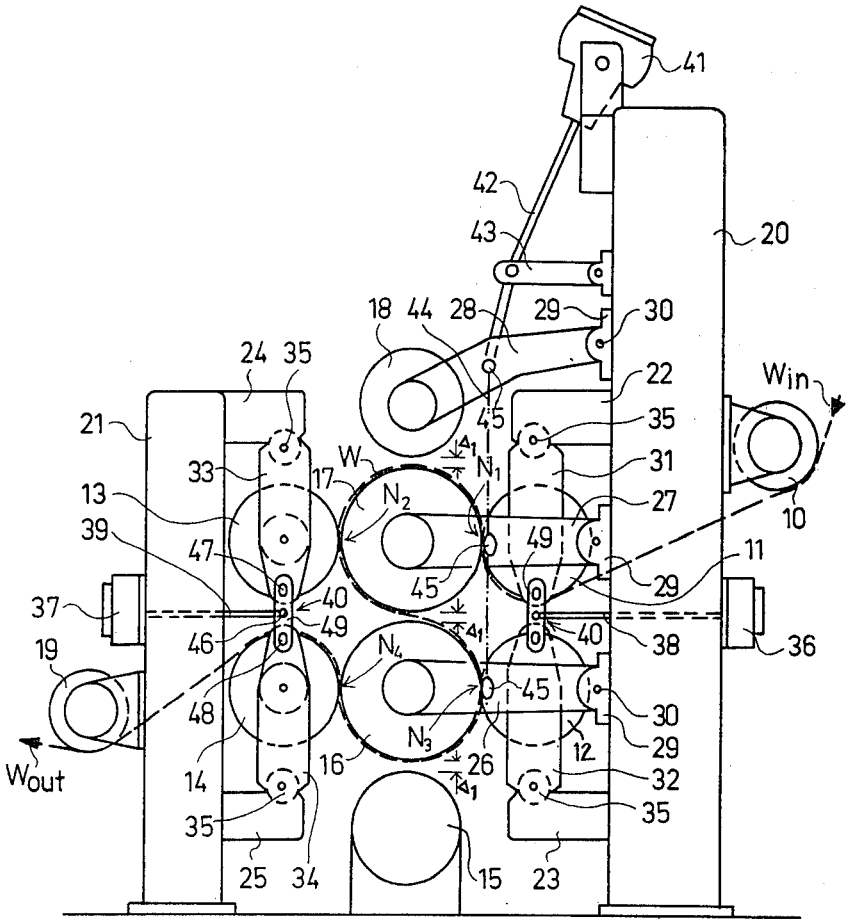
FIG. 1 is a side elevation view of a calender apparatus according to the present invention and illustrating the frame structure as well as the apparatus for supporting an adjustably moving the various rolls.

Referring now to the drawings wherein like reference characters designate identical or corresponding parts throughout the several views, and more particularly FIG. 1, a machine supercalender according to the present invention is illustrated which has been mounted in direct association with a paper machine (not shown) to effect a calendering of the web W emerging therefrom. The frame includes two pairs of upstanding columns 20, 21 (only one of each pair being shown), each column of each pair being situated on a respective side of the machine. The calender rolls are supported between the columns 20 and 21, the rolls 11, 12, 13 and 14 comprising soft rolls, known per se and being of the type conventionally utilized in supercalenders, such for example as paper rolls. The rolls 15, 16, 17 and 18 constitute hard-surface rolls which are also known per se being of the type conventionally used in known machine calenders and comprising, for example, chill-cast rolls.

Figure 3:
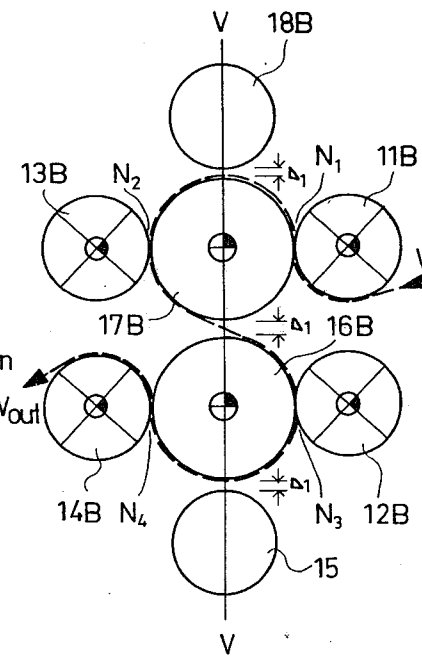
FIG. 3 is a view similar to that of FIG. 2, the rolls being situated during the continuous phase operation of the apparatus.
Figure 2:
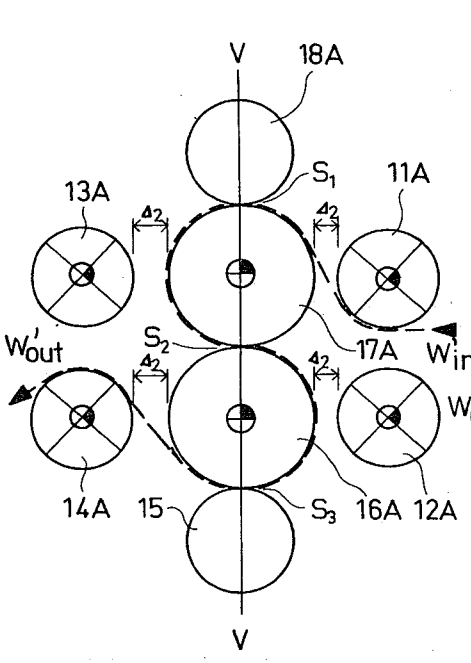
FIG. 2 is a schematic view of the rolls of the calender apparatus of the present invention, the rolls being situated during the threading of the web during the start-up phase of the machine.

Referring to FIGS. 1, 2 and 3, the hard rolls 15, 18 have their respective axes of rotation substantially situated in a common vertical plane V—V so as to constitute an upstanding roll stack. Thus, the upstanding stack includes top and bottom end rolls 18 and 15 and a pair of intermediate rolls, namely, an upper intermediate roll 17 and a lower intermediate rolls 16. The intermediate rolls 16 and 17 each have a diameter which is larger than the diameter of the bottom end roll 15 and the top end roll 18.

FIGS. 1 and 3 illustrate a mutual positioning of the rolls during the continuous operation phase of the apparatus. Four soft rolls 11, 12, 13 and 14 are situated in two pairs, 11, 13 and 12,14, each pair of soft rolls being situated to define a respective pair of soft nips $N_1$, $N_2$ and $N_3$, $N_4$ with a respective one of the intermediate hard rolls 17, 16. Each respective pair of soft nips are symmetrically disposed with respect to the vertical plane V—V which contains the axes of the hard rolls. Thus, soft nips $N_1$ and $N_2$ are symmetrically located with respect to plane V—V as are soft nips $N_3$ and $N_4$. This disposition of the soft rolls is advantageous in that the nip loads in nips $N_1$ and $N_2$ and, similarly, the nip loads in nips $N_3$ and $N_4$ oppose and cancel each other without causing any deflections to occur in the intermediate hard rolls 16, 17. It is noted that in FIGS. 2–4, soft rolls are indicated by crossed diameters while such diameters are absent in the depiction of hard rolls. Additionally, a roll having its own drive associated with it is identified by an interior circle having a shaded quadrant.

Still referring to FIGS. 1 and 3, it is seen that during the continuous operation phase of the apparatus of the invention, at least the hard nips $S_1$, $S_2$ and preferably the hard nip $S_3$ are open, i.e., the surfaces of hard rolls 15, 18 are spaced from each other, while the soft rolls 11, 12, 13 and 14 are in nip-defining contact with the intermediate rolls 16, 17 thereby defining the soft calendering nips $N_1$, $N_2$, $N_3$ and $N_4$. However, as discussed below, the apparatus may be operated in its continuous phase with the nip $S_3$ closed. The web entering the calender is designated $W_{in}$ and the web exiting from the calender is designated $W_{out}$. As seen in FIG. 1, the web entry $W_{in}$ is guided by a guide roll 10 carried in bearing supports which are fixed to the side of the column 20. The web exit $W_{out}$ is guided by a guide roll 19 mounted in bearing supports which are fixed to the outer side of the calender frame column 21.

In the embodiment illustrated in FIG. 1, the hard bottom end roll 15 is journalled in a fixed support carried on the base of the machine frame. The upper hard rolls, i.e., intermediate rolls 16, 17 and top end roll 18 are journalled in support arms 26, 27 and 28, respectively, which are pivotally mounted on respective brackets 29 about pivot pins 30, brackets 29 being mounted on the inner sides of the vertical columns 20. In order to selectively open, close or load the hard nips $S_1$–$S_3$, the support arms 26, 27 and 28 are connected to force apparatus such, for example, as diaphragm loaders 41 (only one shown) mounted on the top end of the vertical columns 20, through articulated rods 42,44. Thus, it is understood that in the illustrated embodiment, two diaphragm motors 41 are provided, one being on each side of the frame, and two sets of rods 42, 44 and lever arms 43 are similarly provided. The rod 44 is illustrated schematically in FIG. 1 by a dash-dot line. The rods 45 are connected to the support arms 26, 27 and 28 in a suitable manner, shown schematically at 45, such that upon the rods 45 being lifted through the action of diaphragm motor 41 through rod 42, the calender rolls 16, 17 and 18 will be lifted so as to define vertical gaps $\Delta 1$, preferably of equal length, between each pair of adjacent hard rolls. In this connection, the connections 45 may comprise pins provided on rods 44 which ride in elongated slots formed in the supporting arms. When the hard nips $S_1$, $S_2$ and $S_3$ are closed, the upper rolls 16, 17 and 18 will freely rest on each other carried by support arms 26, 27 and 28 and with all of these upper hard rolls resting under their own weight on bottom end roll 15.

In certain cases, it may be advantageous to journal the lower intermediate roll 16 in a bracket which is fixed to the frame in which case the support arms 26 illustrated in FIG. 1 and the ancillary apparatus thereto will be omitted. In this case, it is a simple matter to provide for a lifting of rolls 17 and 18 to simultaneously open the nips $S_1$ and $S_2$. However, it is then necessary to provide a mechanism for raising and lowering the bottom end roll 15 in order to open and close the nip $S_3$.

The soft calender rolls 11, 12, 13 and 14 are supported by horizontally extending members 22, 23, 24 and 25, respectively, which extend in cantilever fashion from the inner sides of the frame columns 20, 21. Support arms 31, 32, 33 and 34 each have one hand which is pivotally connected to a respective cantilever member 22, 23, 24 and 25, respectively by a pivot pin 35. The soft rolls 11, 12 13, and 14 are rotatably mounted between respective pairs of support arms 31, 32, 33 and 34, at a central portion of each. In order to selectively open, close and load the soft calender nips $N_1$, $N_2$, $N_3$ and $N_4$, the other ends of the pairs of support arms 31, 32, 33 and 34 are connected to respective pairs of horizontal arms 38, 39 which in turn are associated at one of their ends with force means, such as diaphragm motors 36 and 37 mounted on the outer sides of columns 20, 21. The other ends of the pair of arms 38, 39 are connected to the free ends of support arms 31, 32, 33 and 34 by brackets 40, each of which is respectively coupled to a pair of the soft rolls such that a respective pair of support arms can be pivoted about respective pivot pins 35 by a single source apparatus, e.g., by a single set of diaphragm motors. For example, the support arms 31, 32 can be moved through suitable actuation of the diaphragm motors 36 alone. Since the soft or paper roll 11, 12, 13 and 14 are often damaged and therefore reground so that the diameters of such rolls are variable, the bracket 40 must be constructed so that each soft roll is separately loaded. In view of this requirement, the bracket 40 is designed as comprising a lever arm 49 which is connected at its substantial center to a respective one of the loading arms 38, 39 by a pivot 46. Elongated openings 47, 48 are provided at the ends of arm 49 in which pivot pins (not shown) provided on the support arms extend so as to effect the connection of the arm 49 to the support arms 31–34. Of course, any equivalent arrangement may be utilized or, alternatively, an individual loading means may be provided for each soft roll 11, 12, 13 and 14.

The operation of the calender apparatus illustrated in FIG. 1 will now be described with reference being had to FIGS. 2 and 3. During the start-up phase wherein the web W is threaded through the calender apparatus, e.g., when the paper machine is being accelerated to its normal speed, the calender rolls are in the positions illustrated in FIG. 2 wherein the soft calender nips $N_1$, $N_2$, $N_3$ and $N_4$ are open, preferably with a gap $\Delta 2$ being defined at these nips. On the other hand, hard nips $S_1$, $S_2$ and $S_3$ are closed. The web W enters the calender apparatus at $W_{in}$ and is guided during this operation by soft calender roll 11A wherefrom it is conducted through the hard nips $S_1$, $S_2$ and $S_3$ defined between the hard rolls 15A–18A. From the last hard nip $S_3$, the exiting web $W_{out}$ is guided by the soft roll 14A from the calender apparatus. Immediately upon a continuous conduction of the web W through the calender stack being achieved in a stable manner, the force apparatus in the form of diaphragm motors 36, 37 are operated so as to move the soft calender rolls 11B, 12B, 13B and 14B into the positions illustrated in FIG. 3 until the soft rolls arrive in nip-defining contact with the hard rolls 16B, 17B thereby defining the soft nips $N_1$, $N_2$, $N_3$ and $N_4$. At the same time, the force means in the form of diaphragm motors 41 are actuated to move the hard rolls 15A–18A out of nip-defining contact with each other so that a vertical gap $\Delta 1$ is produced between them. Thus, as seen in FIG. 3, the web W will be conducted only through soft nips $N_1$, $N_2$, $N_3$ and $N_4$ so that supercalendering of the web W will be performed during the continuous operation phase of the apparatus. Upon leaving the calender apparatus, the web W is received by a conventional reeling device (not shown).

According to an important feature of the invention, the hard intermediate rolls 16 and 17 are provided with their own respective independent drives. Preferably, the soft calender rolls 11, 12, 13, and 14 are also provided with independent drives although it is possible to drive these soft rolls from the intermediate hard rolls such, for example, by means of a belt transmission or the like. In this manner, the rotational speed of intermediate rolls 16 and 17 are adjustable independently of each other so that the tension of the web between the second and third soft nips $N_2$ and $N_3$ can be controlled in order to eliminate any possibility of "bagging" due to distention of the web W.

Figure 4:
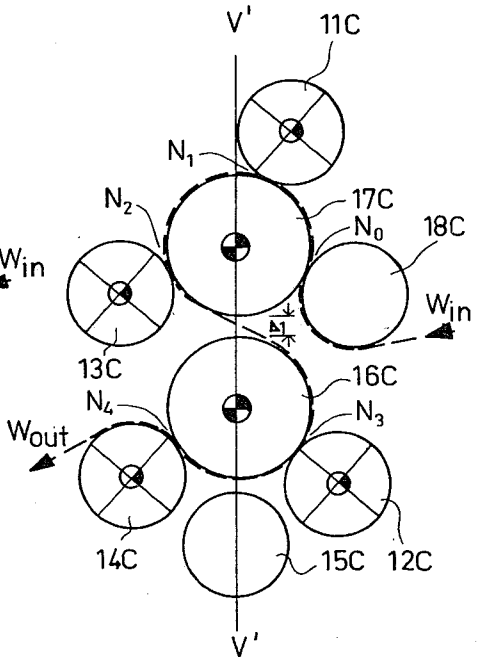
FIG. 4 is a schematic view of another embodiment of the present invention, the rolls being situated during the continuous operation phase.

Referring to FIG. 4, another embodiment of the calender apparatus of the present invention is illustrated, the rolls being illustrated in the positions wherein the apparatus is operating in its continuous operation phase, i.e., in its supercalendering phase. The embodiment illustrated in FIG. 4 differs from the embodiment discussed above in connection with FIGS. 1–3 in that the upstanding calender stack includes three hard rolls 15C, 16C and 17C and in that a fourth hard roll 18C is situated in nip-defining relationship with the upper hard roll 17C to define a hard nip $N_0$ prior to the nips defined by the soft rolls 11C and 13C in the direction of conduction of web W. Thus, three separate nips are defined against the upper hard roll 17C for supercalendering, namely, one hard nip $N_0$ and two soft nips $N_1$ and $N_2$, the latter two soft nips being defined by soft rolls 11C and 13C being urged against the upper hard roll 17C. The arrangement of the lower intermediate roll 16C in the embodiment of FIG. 4 is substantially the same as the corresponding apparatus of the embodiment illustrated in FIGS. 1–3, i.e., soft rolls 12C and 14C define soft supercalendering nips $N_3$ and $N_4$ with the lower intermediate roll 16C.

The mutual location of nips $N_0$, $N_1$ and $N_2$ preferably is selected so that the nip loads will cancel each other in order to eliminate any detrimental deflection of the upper hard roll 17C. This is most easily accomplished by situating the soft roll 11C and, therefore, the nip $N_1$, in the vertical plane V'—V' which contains the axes of the hard rolls 15C–17C while situating the soft roll 13C and hard roll 18C such that the nips defined thereby and by the upper hard roll 17C are symmetrically positioned with respect to the vertical plane V'—V'. By this construction, the calendering loads will be equal in nips $N_0$ and $N_2$.

In the operation of the embodiment illustrated in FIG. 4, in the start-up phase, appropriate force means are actuated such that the soft nips $N_1$–$N_4$ are open and the hard nips $N_0$, $S_2$ and $S_3$ are closed, whereupon the web W is threaded into the apparatus. During this phase of operation, the nip $N_0$ corresponds to the nip $S_1$ in the embodiment illustrated in FIGS. 1–3.

The important difference in the operation of the embodiment of FIG. 4 from that of FIGS. 1–3 is that according to the embodiment of FIG. 4, the hard nip $N_0$ remains closed and is utilized during the continuous operation phase, i.e., when supercalendering is being performed. This has the extremely beneficial effect that any substantial uneven or irregular areas in the web will be substantially eliminated as the web is conducted through the hard nip $N_0$ whereby the supercalendering in the soft nips is facilitated.

Although the embodiment of the invention illustrated in FIGS. 1–3 operates in its continuous operation phase, i.e., during supercalendering, with its hard nips S being open, it should be understood that under certain conditions, it may be desirable to provide the last hard nip $S_3$ defined between rolls 15 and 16 with a light nip pressure such that no spotting or blackening of the web will result.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for calendering a paper web or the like in calendering apparatus including a plurality of hard calendering rolls and a plurality of soft calendering rolls, which hard and soft rolls are situated with respect to each other to define a plurality of hard nips and a plurality of soft or supercalendering nips, comprising the steps of: initially situating said hard and soft rolls with respect to each other prior to the start-up phase of the operation of the calendering apparatus so that the hard nips defined by the hard rolls are closed and so that the supercalendering nips defined by soft roll pairs with respective hard rolls are open, threading the paper web during the start-up phase of operation through the closed hard nips and open supercalendering nips; situating said hard and soft rolls with respect to each other at the end of the start-up phase of the operation so that substantially all of the hard nips are open and so that the supercalendering nips are closed; and operating the calendering apparatus in a continuous phase operation to perform continuous supercalendering of the paper web.

2. The method defined in claim 1 further comprising the step of passing the paper web through a single closed hard nip prior to performing the supercalendering thereof.

3. In apparatus for calendering a paper web or the like adapted to be directly associated with a paper making machine or the like including a plurality of hard calender rolls and a plurality of soft calender rolls situated with respect to the hard calender rolls to define a plurality of hard nips and a plurality of soft or supercalendering nips therewith, the improvement comprising: means associated with respective ones of said calendering rolls for supporting the same; and force means operatively associated with said supporting means for closing said hard nips and opening said supercalendering nips while the paper web is threaded at the start-up phase of operation through the calendering apparatus and for opening substantially all of said hard nips and closing said supercalendering nips after the web is running continuously through the calendering apparatus, whereby the apparatus is operated to perform continuous supercalendering of the paper web.

4. The combination of claim 3 wherein said plurality of hard calendering rolls comprise at least three hard rolls having respective axes of rotation which are substantially situated in a common vertical plane so as to constitute a roll stack.

5. The combination of claim 4 wherein said plurality of soft calendering rolls comprise four soft rolls arranged in two pairs, each being situated in nip-defining relationship with one of said two upper hard rolls in the stack defined by said hard rolls.

6. The combination of claim 5 wherein said supporting means comprise movably mounted support arms on which said soft rolls are journalled and wherein said force means comprise means for selectively moving said movable support arms whereby said soft nips can be opened while the web is being threaded through the calender apparatus, closed and loaded when calendering is being performed.

7. The combination of claim 6 wherein said movable support arms extend substantially vertically.

8. The combination of claim 4 wherein said plurality of hard rolls constituting the roll stack comprise four hard rolls including top and bottom end rolls and between the latter a pair of intermediate rolls, one of which is an upper intermediate roll and the other of which is a lower intermediate roll.

9. The combination of claim 8 wherein two of said soft rolls are situated in nip-defining relationship with said upper intermediate roll to define two soft nips with said upper intermediate roll in addition to said hard nip defined by said top end roll and said upper intermediate roll.

10. The combination of claim 8 wherein said plurality of soft calendering rolls comprise two pairs of soft rolls, each pair of soft rolls being situated to define a respective pair of soft nips with a respective one of said intermediate rolls and which are symmetrically disposed with respect to said vertical plane which contains the axes of said hard rolls.

11. The combination of claim 8 further including a separate speed-adjustable means for driving each of said intermediate hard rolls whereby the tension of the web between consecutive soft nips defined by said intermediate hard rolls and associated soft rolls can be controlled.

12. The combination of claim 4 wherein said plurality of hard calender rolls comprises a fourth hard calender roll situated in nip-defining relationship with the uppermost hard roll of the stack to define a hard nip which is prior to said soft nips in the path of travel of the web.

13. The combination of claim 4 wherein said plurality of soft calendering rolls comprise two pairs of soft rolls, each pair of soft rolls being situated to define a respective pair of soft nips with a respective one of said upper and lower intermediate hard rolls.

14. The combination of claim 13 and wherein said plurality of hard calender rolls comprises a fourth hard calender roll situated in nip-defining relationship with the uppermost hard roll of the stack to define a hard nip which is prior to said soft nips in the path of travel of the web.

15. The combination of claim 13 wherein each pair of soft rolls is situated with respect to a respective hard roll to define a respective pair of soft nips symmetrically situated with respect to said vertical plane containing the axes of said hard rolls.

16. The combination of claim 4 wherein one of the lowermost and next lowermost hard calender rolls is fixedly journalled and wherein said supporting means comprise movably mounted support arms on which the remainder of said hard calender rolls are journalled, and wherein said force means comprise means for selectively raising and lowering said movable support arms to selectively open and close the hard nips.

17. The combination of claim 4 wherein the two upper hard rolls of the stack each have a diameter which is greater than the diameter of the lowermost hard roll.

* * * * *